US010156823B2

(12) United States Patent
Takano

(10) Patent No.: US 10,156,823 B2
(45) Date of Patent: Dec. 18, 2018

(54) IMAGE FORMING APPARATUS AND CONTROL METHOD THEREOF

(71) Applicants: KABUSHIKI KAISHA TOSHIBA, Tokyo (JP); TOSHIBA TEC KABUSHIKI KAISHA, Tokyo (JP)

(72) Inventor: Taishi Takano, Sunto Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/628,905

(22) Filed: Jun. 21, 2017

(65) Prior Publication Data

US 2018/0253048 A1 Sep. 6, 2018

(30) Foreign Application Priority Data

Mar. 2, 2017 (JP) ..... 2017-039896

(51) Int. Cl.
*G03G 15/00* (2006.01)

(52) U.S. Cl.
CPC ..... *G03G 15/505* (2013.01); *G03G 15/5008* (2013.01); *G03G 15/5045* (2013.01); *G03G 15/5004* (2013.01)

(58) Field of Classification Search
CPC ..... G03G 15/5045; G03G 15/0087–15/0091
USPC ..... 399/256, 44, 94
See application file for complete search history.

(56) References Cited

U.S. PATENT DOCUMENTS

| | | | | |
|---|---|---|---|---|
| 7,650,100 | B2 * | 1/2010 | Murata | G03G 15/0849 399/253 |
| 8,045,867 | B2 * | 10/2011 | Park | G03G 15/0822 399/44 |
| 2011/0222880 | A1 * | 9/2011 | Kabashima | G03G 15/0818 399/44 |
| 2016/0116877 | A1 * | 4/2016 | Matsushita | G03G 15/50 399/53 |

FOREIGN PATENT DOCUMENTS

| | | |
|---|---|---|
| JP | H11-344861 | 12/1999 |

* cited by examiner

*Primary Examiner* — David M Gray
*Assistant Examiner* — Arlene Heredia Ocasio
(74) *Attorney, Agent, or Firm* — Patterson & Sheridan, LLP

(57) ABSTRACT

According to an embodiment, an image forming apparatus includes a developing device including a toner receiving portion configured to contain toner and a movable part moveable at a first speed and a second speed, the moveable part at least partially disposed within the toner receiving portion, a temperature sensor disposed adjacent to the developing device, and a control unit operatively coupled to the temperature sensor and the developing device, wherein the control unit controls the movable part to move at a first speed when the temperature sensor detects a temperature less than a first temperature and controls the movable part to move at a second speed lower than the first speed when the detected temperature is less than a second temperature that is greater than the first temperature.

19 Claims, 5 Drawing Sheets

IMAGE FORMING APPARATUS AND CONTROL METHOD THEREOF

CROSS-REFERENCE TO RELATED APPLICATION

This application is based upon and claims the benefit of priority from Japanese Patent Application No. 2017-039896, filed Mar. 2, 2017, the entire contents of which are incorporated herein by reference.

FIELD

Embodiments described herein relate to an image forming apparatus.

BACKGROUND

In electrophotographic devices, energy-saving by low-temperature image fixing is being researched. In recent years, the image fixing temperature has been lowered by altering toner material properties or improving fixing units, but there is a problem in that preservation properties of a low-temperature fixing toner deteriorate. The preservation properties mean the resistance of the toner to a phenomenon in which toner inside the electrophotographic device are affected by heat or vibration from the outside such that the toner can melt and become fused together during transportation or use of the electrophotographic device. In general, toners having sufficient preservation properties in an environment of 50° C. to 60° C. are required, and from this viewpoint, improvement of wax or improvement of a dispersion state and the like of such materials is in progress. Meanwhile, some of the electrophotographic devices have a printing speed of equal to or greater than 200 mm/second. In these high-speed electrophotographic devices, when continuous printing is performed, the temperature inside the electrophotographic device quickly becomes high. Therefore, the electrophotographic device detects the peripheral temperature, temporarily suspends the print operation when the detected temperature exceeds a certain threshold, and restarts the print operation after the temperature has decreased to an acceptable temperature for use.

Since the electrophotographic device uses movable parts such as a developing roller or an auger of a developing device, some portions come to have a remarkably high temperature locally due to the heat of rolling friction between a rotary shaft and a bearing. In a state where there is a portion having a high temperature locally, when operations of all the devices are suspended for stopping the print operation, the toner in a developing unit is not moved, and the toner may be exposed to an environment of a high temperature locally. In this case, even if the toner satisfies the preservation properties, a phenomenon in which toners are melted in the developing device is observed. The melted toner agglomerate upon the decrease of the temperature, and may become fixed in the developing device. The toner which is melted once in the developing device has deteriorated fluidity and electrostatic properties, and therefore may cause an abnormality such as a white line or a blur in an image printed therewith. In particular, since the toner having excellent low-temperature fixing properties can be melted at a low temperature, the melting thereof in the developing device easily occurs.

DETAILED DESCRIPTION

Figure 1:
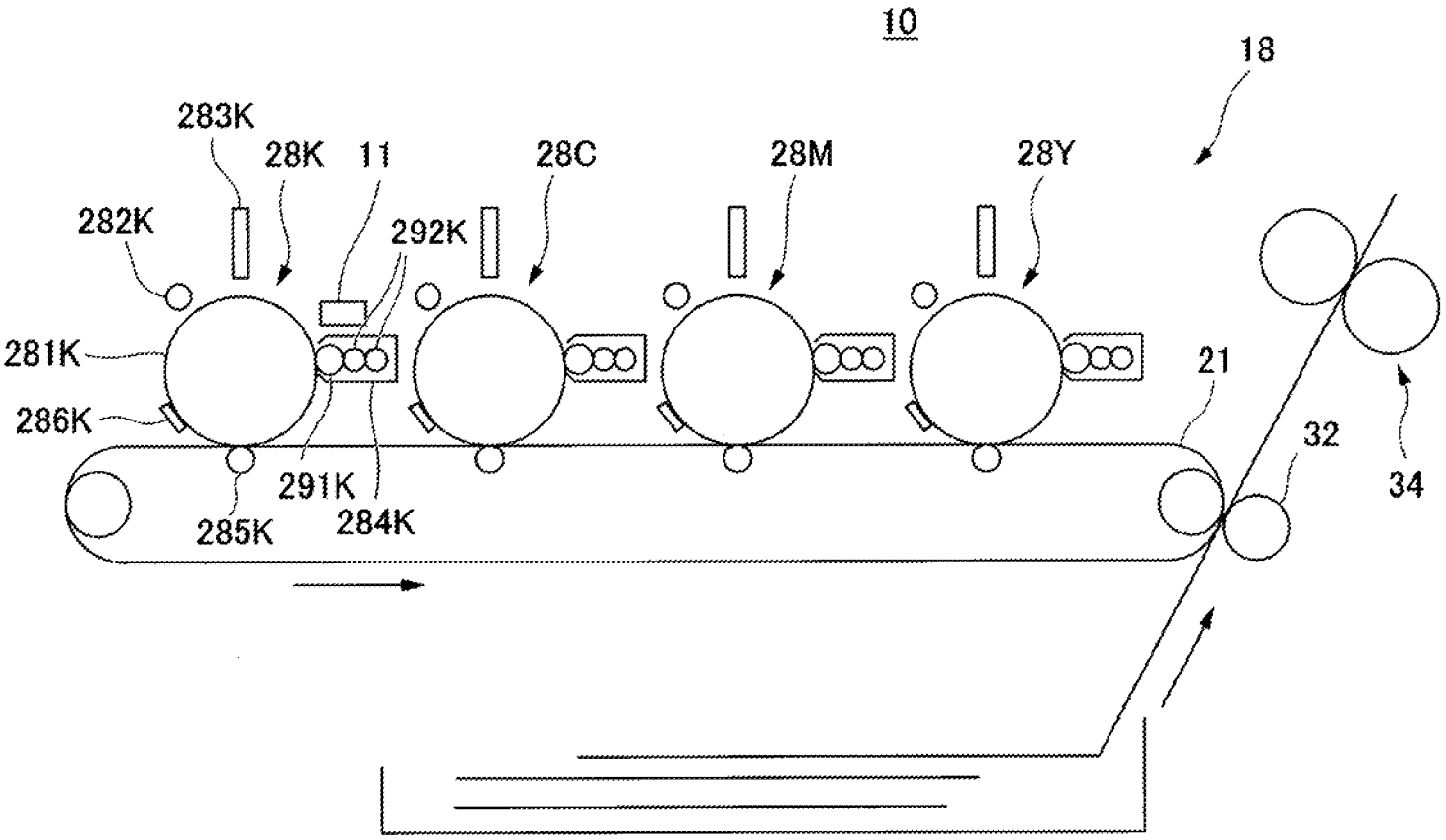
FIG. 1 is a diagram schematically illustrating an example of an internal configuration of an image forming apparatus of an embodiment.

Embodiments provide an image forming apparatus which can prevent toner from being melted before it is used to form an image.

An image forming apparatus of an embodiment includes includes a developing device including a toner receiving portion configured to contain a toner and a movable part moveable at a first speed and a second speed, the moveable part at least partially disposed within the toner receiving portion, a temperature sensor disposed adjacent to the developing device, and a control unit operatively coupled to the temperature sensor and the developing device, wherein the control unit controls the movable part to move at a first speed when the temperature sensor detects a temperature less than a first temperature and controls the movable part to move at a second speed lower than the first speed when the detected temperature is less than a second temperature that is greater than the first temperature.

Hereinafter, an image forming apparatus of an embodiment will be described with reference to the drawings. In each drawing illustrated below, the same reference numeral is assigned to the same elements and configurations.

First, a diagram schematically illustrating an example of an internal configuration of the image forming apparatus of the embodiment is described by using FIG. 1.

In FIG. 1, an image forming apparatus 10 represents a color image forming apparatus. The image forming apparatus 10 includes a printer unit 18. The printer unit 18 includes an image forming unit 28Y, an image forming unit 28M, an image forming unit 28C, and an image forming unit 28K. The image forming unit 28Y forms a toner image of a yellow color. In the electrophotographic method of two components, the developer contains a toner and a carrier. The image forming unit 28Y forms an image by primary-transferring a toner image of a yellow color onto an intermediate transfer belt 21. Similarly, the image forming unit 28M forms a toner image of a magenta color on the intermediate transfer belt 21. The image forming unit 28C forms a toner image of a cyan color on the intermediate transfer belt 21. In addition, the image forming unit 28K forms a toner image of a black color on the intermediate transfer belt 21. The printer unit 18 can form a color image using the image forming units of respective colors of YMCK. The image forming unit 28Y to the image forming unit 28K are image forming units having a similar configuration, and thus in the following description, the description of all of them is made by assigning reference numerals to the image forming unit 28K.

A photoreceptor 281K is, for example, an organic photoreceptor, or an amorphous silicon photoreceptor. The photoreceptor 281K includes a charge generation layer and a charge transportation layer (and a protection layer), and can be charged by negative charge or positive charge.

The image forming unit 28K includes the photoreceptor 281K, a charging device 282K, an exposure unit 283K, a developing device 284K, a primary transfer roller 285K, and a cleaning device 286K. The charging device 282K is, for example, a charger wire, a comb-type charger, a corona charger such as scorotron, a contact charging roller, a non-contact charging roller, and a solid charger. The charging device 282K evenly imparts a surface potential of, for example, −500 to 800 V to the surface of the photoreceptor 281K.

The exposure unit 283K exposes the photoreceptor 281K by laser light, LED light, or the like, and thereby forms an electrostatic latent image on the surface of the photoreceptor 281K.

The developing device 284K visualizes (develops) the electrostatic latent image formed on the photoreceptor 281K using the toner. The developing device 284K includes a movable part such as a developing roller 291K and an auger 292K. The developing roller 291K includes a magnet roller, for example. The developing roller 291K including the magnet roller is rotated so as to transport the developer composed of two components to the photoreceptor 281K by the magnetic roller, and thereby causes the toner to be attached to the photoreceptor 281K so as to develop the toner image. The developing bias is applied to the developing roller 291K so that toner is easily attached to the surface of the photoreceptor 281K. In the developer, the toner concentration is decreased because the toner is attached to the photoreceptor 281K. The toner concentration is detected by a toner concentration sensor (not illustrated). When the decrease of the toner concentration is detected, toner is supplied from a hopper (not illustrated). The auger 292K is rotated so as to stir the developer of which the toner concentration has decreased, with the newly supplied toner, homogenizes the toner concentration of the developer, and supplies the developer to the developing roller 291K.

The auger 292K is rotated by a driving motor (not illustrated). The auger 292K requires stirring power based on the amount of the toner supplied to the photoreceptor 281K to homogenize the toner concentration which is reduced by the developing roller 291K. The stirring power is changed by the rotational speed of an auger screw of the auger 292K. If the image forming process is performed at a high speed, in order to obtain stirring power corresponding to the high speed, the auger 292K requires a predetermined rotational speed. In order to stir the developer, if the rotational speed of the auger 292K is increased, as a result of the increase, more frictional heat with respect to the developer is generated. In addition, the movable part such as a bearing for supporting the rotation of the auger 292K or the developing roller 291K, and a gear or a motor for transmitting the rotational force to the auger 292K, generate heat according to their operation such as rotation. The amount of heat generated from the auger 292K and the like becomes greater if the operating speed such as their rotational speed is increased. The operating speed of the auger 292K or the like results from the process speed. The process speed is determined by the printing speed (PPM or CPM) of the image forming apparatus 10. For example, if the image forming apparatus is a high-speed machine of which the process speed is equal to or greater than 200 mm/second, through experiments, it is confirmed that the temperature of the developing device 284K is significantly increased due to the operation of the auger 292K or the like. That is, the temperature increase of the developing device 284K becomes a problem in a high-speed machine of which the process speed is equal to or greater than 200 mm/second.

A temperature sensor 11 is disposed in the vicinity of the developing device 284K, and it indirectly measures the temperature of the developer. Since the developer is homogenized by the rotation of the auger 292K or the like, during the rotation of the auger 292K or the like, the temperature inside the developing device 284K is homogenized. Accordingly, even if the temperature sensor 11 is disposed in the vicinity of the developing device 284K, the temperature sensor 11 can indirectly measure the temperature of the developer. The temperature sensor 11 may be a temperature sensor for other purposes which is disposed inside the image forming apparatus 10 and serves as a sensor for measuring the temperature of the developer. As the temperature sensor 11, for example, a thermistor or a resistance thermometer of a temperature measuring resistor can be used. In FIG. 1, a case in which the temperature sensor 11 is located in the vicinity of the developing device 284K is illustrated, and the temperatures of the developing devices of other colors are not measured. However, a temperature sensor 11 may also be disposed in the vicinity of the developing devices of the other colors.

The primary transfer roller 285K primary-transfers the toner image formed on the photoreceptor 281K to the intermediate transfer belt 21. A bias voltage of a reversed polarity with respect to the toner is applied to the primary transfer roller 285K so that the transfer of the toner from the photoreceptor 281K to the intermediate transfer belt 21 is urged electrostatically. The cleaning device 286K cleans the toner remaining on the photoreceptor 281K after it passes over the intermediate transfer belt 21. The intermediate transfer belt 21 is rotated in a direction of the arrow below the intermediate transfer belt 21 as illustrated in FIG. 1. The intermediate transfer belt 21 carries the toner image of each color formed by the image forming unit 28Y, by the image forming unit 28M, by the image forming unit 28C, and by the image forming unit 28K in that order. A secondary transfer roller 32 secondary-transfers the toner image of each color carried on the intermediate transfer belt 21 to a sheet. A bias voltage of a reversed polarity with respect to the toner is applied to the secondary transfer roller 32 so that the transfer of the toner from the intermediate transfer belt 21 to the sheet is urged electrostatically.

A fixing device 34 fixes the toner, which is secondary-transferred to the sheet, by using predetermined temperature and pressure. The temperature of the fixing device 34 results from heat characteristics of the toner. The heat characteristics of the toner are characteristics of the viscosity change of the toner on the sheet. If the temperature is increased, the viscosity of the toner is lowered, and thus the toner can be fixed to the sheet. The fixable viscosity varies depending on the raw material (for example, paper or plastic film) of the sheet and the surface condition of the sheet.

Hereinafter, toner will be described. In order to select a toner suitably used in the embodiment, first, Toner 1 to Toner 3 were manufactured. As the developer, each toner was evaluated for low-temperature fixing properties, preservation properties, and a glass transition point temperature. The results are listed in Table 1.

TABLE 1

| | Fixing Temperature | Preservation Properties | Toner Tg |
|---|---|---|---|
| Toner 1 | 121° C. | 0.6 g | 43.4° C. |
| Toner 2 | 127° C. | 3.2 g | 44.2° C. |
| Toner 3 | 140° C. | 1.0 g | 57.5° C. |

| <Toner 1> | |
|---|---|
| Polyester resin (binder) | 85 parts by weight |
| Crystalline polyester resin | 3 parts by weight |
| Ester wax A | 5 parts by weight |
| Coloring agent (MA-100) | 6 parts by weight |
| Charge control agent (polysaccharide compound containing Al + Mg) | 1 part by weight |

To obtain Toner 1, the above materials were mixed by using a Henschel Mixer, and then were melted and kneaded by a biaxial extruder. After the resulting melted and kneaded material was cooled, the material was pulverized using a hammer mill, and then was finely pulverized using a jet pulverizer and classified, and thereby powder having a volume mean diameter of 7 μm and a toner Tg of 43.4° C. was obtained.

The following additives were added to 100 parts by weight of the powder and mixed using the Henschel Mixer to manufacture Toner 1.

| | |
|---|---|
| Hydrophobic silica having an average primary-particle size of 8 nm | 0.8 parts by weight |
| Hydrophobic silica having an average primary-particle size of 100 nm | 0.8 parts by weight |
| Hydrophobic titanium oxide having an average primary-particle size of 20 nm | 0.5 parts by weight |

The obtained toner was stirred with 100 parts by weight of ferrite carrier of which the surface is coated with silicone resins having an average particle size of 40 μm, in a proportion of 6 parts by weight, by using the TURBULA mixer to obtain a developer.

| <Toner 2> | |
|---|---|
| Polyester resin (binder) | 85 parts by weight |
| Crystalline polyester resin | 3 parts by weight |
| Ester wax B | 5 parts by weight |
| Coloring agent (MA-100) | 6 parts by weight |
| Charge control agent (polysaccharide compound containing Al + Mg) | 1 part by weight |

To obtain Toner 2, the above materials were mixed using a Henschel Mixer, and then were melted and kneaded by a biaxial extruder. After the resulting melted and kneaded material was cooled, the material was pulverized using a hammer mill, and then was finely pulverized using a jet pulverizer and classified, and thereby powder having a volume mean diameter of 7 μm and a toner Tg of 44.2° C. was obtained.

The following additives were added to 100 parts by weight of the powder and mixed using the Henschel Mixer to manufacture Toner 2.

| | |
|---|---|
| Hydrophobic silica having an average primary-particle size of 8 nm | 0.8 parts by weight |
| Hydrophobic silica having an average primary-particle size of 100 nm | 0.8 parts by weight |
| Hydrophobic titanium oxide having an average primary-particle size of 20 nm | 0.5 parts by weight |

The obtained toner was stirred with 100 parts by weight of ferrite carrier of which the surface is coated with silicone resins having an average particle size of 40 μm, in a proportion of 6 parts by weight, by using the TURBULA mixer to obtain a developer.

| <Toner 3> | |
|---|---|
| Polyester resin (binder) | 68 parts by weight |
| Crystalline polyester resin | 15 parts by weight |
| Ester wax C | 10 parts by weight |
| Coloring agent (MA-100) | 6 parts by weight |
| Charge control agent (polysaccharide compound containing Al + Mg) | 1 part by weight |

To obtain Toner 3 the above materials were mixed using a Henschel Mixer, and then were melted and kneaded by a biaxial extruder. After the resulting melted and kneaded material was cooled, the material was pulverized by using a hammer mill, and then was finely pulverized using a jet pulverizer and classified, and thereby powder having a volume mean diameter of 7 μm and a toner Tg of 33.5° C. was obtained.

The following additives were added to 100 parts by weight of the powder and mixed by using the Henschel Mixer to manufacture Toner 3.

| | |
|---|---|
| Hydrophobic silica having an average primary-particle size of 8 nm | 0.8 parts by weight |
| Hydrophobia silica having an average primary-particle size of 100 nm | 0.8 parts by weight |
| Hydrophobic titanium oxide having an average primary-particle size of 20 nm | 0.5 parts by weight |

The obtained toner was stirred with 100 parts by weight of ferrite carrier of which the surface is coated with silicone resins having an average particle size of 40 μm, in a proportion of 6 parts by weight, by using the TURBULA mixer to obtain a developer.

In addition, Ester Waxes A, B, and C were prepared in the following manner.

80 parts by weight of long-chain alkyl carboxylic acid components and 20 parts by weight of long-chain alkyl alcohol components were input to a four necked flask to which a stirrer, a thermocouple, and a nitrogen introduction pipe are attached, and esterification was carried out at 220° C. under a nitrogen stream. After the obtained reaction product was diluted in a mixed solvent of toluene and ethanol, a sodium hydroxide aqueous solution was added thereto and the resultant was stirred at 70° C. for 30 minutes. Thereafter, the resultant was left for 30 minutes and the water layer part was removed. Further, after ion exchanged water is added thereto and the resultant was stirred at 70° C. for 30 minutes, an operation of leaving the resultant for 30 minutes and removing the water layer part was repeated 5 times. Under the reduced pressure, the solvent of the obtained ester layer was distilled, and thereby Ester Wax A was obtained. The structural formula of the ester wax is represented in the following Formula (1).

$$CH_3(CH_2)_nCOO(CH_2)_mCH_3 \text{ (where } n \text{ and } m \text{ are integers)} \quad (1)$$

Each ester wax was prepared by changing the type and amount of long-chain alkyl carboxylic acids and the type and amount of long-chain alkyl alcohols. Specifically, in a case of broadening the distribution of carbon numbers, the distribution was adjusted by using a plurality of types of both the long-chain alkyl carboxylic acid components and the long-chain alkyl alcohol components. The contents of main ester compounds constituting Ester Waxes A to C are listed in Table 2.

TABLE 2

| | Contents of Main Ester Compounds |
|---|---|
| Ester Wax A | C44 (40.6%), C42 (21.0%), C40 (10.7%) |
| Ester Wax B | C44 (68.0%), C42 (17.8%), C40 (9.8%) |
| Ester Wax C | C44 (40.0%), C42 (27.0%), C40 (13.8%) |

<Test Method of Low-Temperature Fixing Properties>

Based on the fixing system of e-STUDIO6530C (manufactured by Toshiba Corporation) which is commercially available, modification was performed so as to change the setting temperature by increments of 0.1° C. from 100° C. to 200° C. The test was carried out from the start at a setting temperature of 150° C., and ten sheets of a solid image of which the amount of attached toner is 1.5 mg/cm$^2$ were obtained. In a case where by decreasing the setting temperature image peeling due to offset or unfixed toner does not even slightly occur in the ten sheets, the lower-limit fixing temperature where image peeling does not occur was determined. It is preferable that the fixing temperature is low, and it is not favorable that the temperature is higher than 125° C.

<Test Method of Preservation Properties>

15 g of toner which was left for 10 hours at 55° C. was screened using a mesh, and the toner remaining on the mesh was quantified. It is preferable that the amount of the toner remaining on the mesh is small, and it is not favorable that the amount is greater than 3 g.

The glass transition point (Tg) is a temperature (° C.) at which the glass transition occurs. The glass transition point is a numerical value measured based on JIS K 6240, and is measured, for example, in differential scanning calorimetry (DSC). In the embodiment, a differential scanning calorimeter (Q2000 manufactured by TA Instruments) was used.

The glass transition point is a temperature at which the toner transitions to a glass state. For a toner having a high glass transition point, it is necessary to increase the temperature of the fixing device 34, and the power consumption of the fixing device 34 is increased. The temperature of the fixing device 34 is set to a sufficient temperature in consideration of a glass transition point of the toner, an amount of toner on a sheet, thermal capacity of a sheet, and a printing speed.

In the embodiment, Toner 1 was adopted in the viewpoint of adopting a toner which satisfies a fixing temperature of equal to or less than 125 degrees, the test result of preservation properties of equal to or less than 3 g, and a toner Tg of equal to or less than 50° C.

The glass transition point of the toner being low is an important element for decreasing the temperature of the fixing device 34, and the power consumption of the fixing device 34 is reduced by decreasing the glass transition point. Meanwhile, if the glass transition point becomes too low, since there is a harmful effect because the toner is easily melted, the glass transition point is preferably set to a range of 30° C. to 50° C. and more preferably 40° C. to 50° C. However, the low-temperature fixing toner, which has heat characteristics of a glass transition point of equal to or less than 50° C., is also easily melted inside the developing device 284K.

In this manner, if the image forming apparatus is a high-speed machine of which the process speed is equal to or greater than 200 mm/second, the temperature is significantly increased due to the operation of the auger 292K or the like. In a case of the high-speed machine of which the process speed is equal to or greater than 200 mm/second, in some cases, the internal temperature of the developing device reaches or exceeds the glass transition point of the toner. If the temperature of the developer exceeds the glass transition point, toner is melted and the toner becomes a mass (becomes fused together in clumps). Therefore, toner of which the glass transition point is equal to or less than 50° C. is used. In the image forming apparatus of which the process speed is equal to or greater than 200 mm/second, the temperature of the developer is controlled. Specifically, in a case where the temperature of the developer is about to exceed the glass transition point, the printing operation is stopped and cooling time is provided for the developer temperature to fall. For example, the movable part such as a bearing for supporting the rotation of the auger 292K, and a gear or a motor for transmitting the rotational force to the auger 292K are heat sources described above. Accordingly, by stopping the printing operation, the heat generation from those components is stopped and thus cooling can be performed. Hereinafter, a state in which printing is stopped due to the temperature increase is referred to as "printing stoppage state". In addition, a state in which the temperature is not increased and printing can be performed is referred to as "printable state". The printing stoppage state and the printable state are operation states (operation modes) of the image forming apparatus 10 which can transition from one state to the other state.

However, even if the printing operation is stopped, the temperature of a part having high thermal capacity may possibly continue to be increased. For example, the temperature of the movable part such as a bearing of the auger 292K or the like may possibly continue to be increased even if the printing operation is stopped. In addition, during the printing operation, the developer is moved by the rotation of the auger 292K or the like as described above, and the temperature of the inside of the developing device 284K becomes homogenous. However, if the printing operation is stopped and the rotation of the auger 292K or the like is stopped, the temperature of the components such as a bearing of the auger 292K is not dispersed to other parts by the developer. Accordingly, a hot spot of a high temperature is generated in the vicinity of the movable part such as a bearing of the auger 292K or the like. The developer residing in the hot spot reaches a high temperature and thus may possibly be melted. For example, in a case where the printing operation is stopped at a low temperature such that the temperature of the hot spot does not become high, the time of the printable state becomes short, and the time of the printing stoppage state becomes long.

In the embodiment, by rotating the auger 292K or the like at a low speed in the printing stoppage state, the amount of heat generated from a bearing of the auger 292K or the like is reduced. By rotating the auger 292K or the like, the developer is stirred and moved, and thus the developer is prevented from staying in the hot spot during a printing stoppage state. Further, by rotating the auger 292K or the like, the heat of the hot spot can be dispersed by the movement of the developer. The operation of the auger 292K or the like in the printing stoppage state will be described in detail below by using FIG. 5 or the like.

In FIG. 1, the image forming apparatus 10 which performs color printing using the image forming unit 28Y to the image forming unit 28K is exemplified. However, the image forming apparatus may only include an image forming unit which forms an image by using a black color toner. In addition, the image forming apparatus may only include an image forming unit which forms an image by using a decolorable toner. In the following description, in a case where common matters in which colors of the toner are not limited are described, description is made as the image forming unit 28, the developing device 284, and the auger 292.

Next, a block diagram illustrating an example of a functional configuration of image forming apparatus of the embodiment will be described by using FIG. 2.

Figure 2:
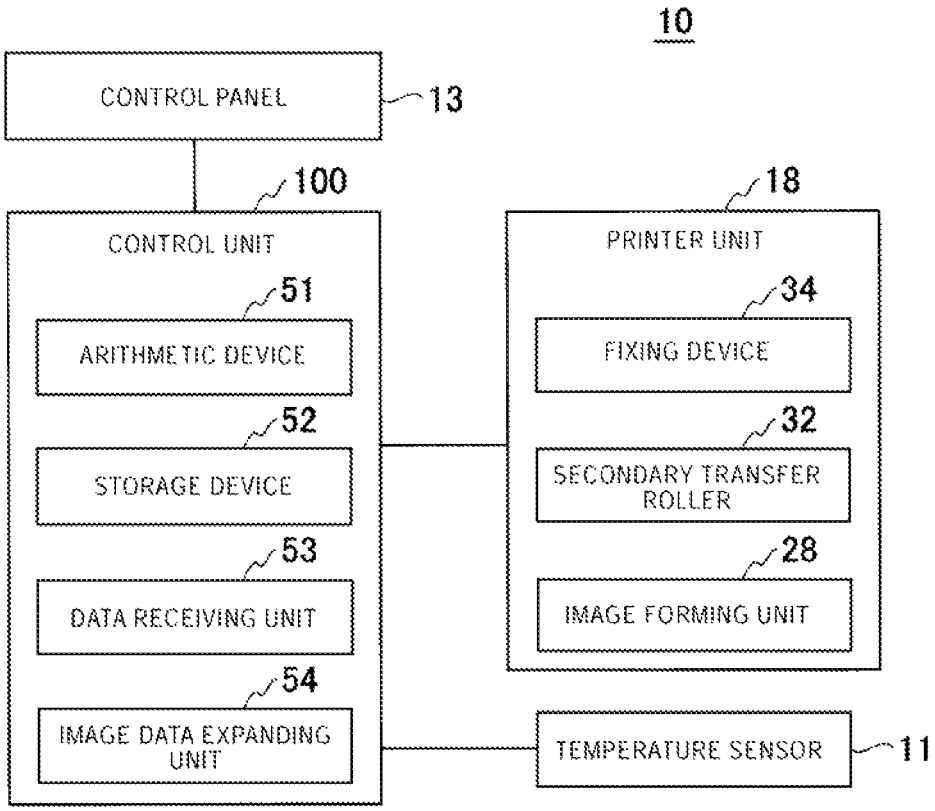
FIG. 2 is a block diagram illustrating an example of a functional configuration of the image forming apparatus of the embodiment.

In FIG. 2, the image forming apparatus 10 includes a control unit 100, a control panel 13, the printer unit 18, and the temperature sensor 11.

The control unit 100 includes an arithmetic device 51 and a storage device 52. The arithmetic device 51 controls the control panel 13 and the printer unit 18 according to an image processing program stored in the storage device 52.

The arithmetic device 51 is, for example, a central processing unit (CPU), or an application specific integrated circuit (ASIC). The storage device 52 is read only memory (ROM), random access memory (RAM), a hard disk drive (HDD), or a solid-state drive (SSD). A data receiving unit 53 receives printing data (for example, data described in the page description language and the like) representing an image to be printed, from a host such as a personal computer (PC), and stores the received printing data in the storage device 52. An image data expanding unit 54 determines printing conditions from the printing data, which is stored in the storage device 52 by the data receiving unit 53, expands the printing image into data (for example, raster data or the like) that the printer unit 18 can print, and stores the developed data in the storage device 52.

The printer unit 18 includes the fixing device 34, the secondary transfer roller 32, and the image forming unit 28. The printer unit 18 forms an image on a sheet based on the data stored in the storage device 52 by the image data expanding unit 54.

The control unit 100 obtains temperature data from the temperature sensor 11. As described in FIG. 1, the temperature sensor 11 is disposed in the vicinity of the developing device 284. The control unit 100 estimates the internal temperature of the developing device 284 or the temperature of the developer based on the temperature data obtained from the temperature sensor 11. The control unit 100 may estimate the internal temperature of the developing device 284 in the future, based on, for example, the obtained temperature data and information regarding the number of sheets to be printed. In a case where the estimated internal temperature of the developing device 284 satisfies a predetermined condition, the control unit 100 temporarily stops the printing operation of the printer unit to cause the printing stoppage state to occur. The predetermined condition is that, for example, the temperature data obtained from the temperature sensor 11 is equal to or greater than a predetermined value.

The control unit 100 stores the printing data, which is received from the PC by the data receiving unit 53, in the storage device 52. In the printable state, the control unit 100 rasterizes the printing data stored in the storage device 52, for each page, and performs printing in the printer unit 18. In a case where the temperature is equal to or greater than the predetermined value, the control unit 100 suspends the rasterizing of the printing data for the next page, and does not feed a sheet on which the data for the next page is printed. The control unit 100 completes the printing of the sheet on which printing is being performed, and causes the printing stoppage state after the corresponding sheet is discharged. In the printing stoppage state, the control unit 100 does not read the printing data stored in the storage device 52, and does not perform the printing operation in the printer unit 18. In a case where the data receiving unit 53 receives printing data from the PC while in the printing stoppage state, the control unit 100 stores the received printing data in the storage device 52. When the image forming apparatus next comes to be in the printable state, the control unit 100 rasterizes the remaining printing data stored in the storage device 52 for each page, and performs printing in the printer unit 18.

The control unit 100 may cause the printing stoppage state to occur after printing of the printing data which is being printed for all the pages is completed. In addition, in a case where the number of remaining pages is within a predetermined number of pages by referring to the number of remaining pages of the printing data which is being printed, the control unit 100 may cause the printing stoppage state to occur after printing for all the pages is completed. In addition, the control unit 100 may determine whether to cause the printing stoppage state to occur by predicting the temperature at the time when printing for all the pages is completed, based on the temperature data obtained from the temperature sensor 11 and the number of remaining pages.

The control panel 13 includes input keys and a display unit. For example, the input keys receive an input from a user. For example, the display unit is of a touch panel type. The display unit receives an input from a user and performs display to the user. For example, the control panel 13 displays items relating to the operations of the image forming apparatus 10, on the display unit so that the items can be set. The control panel 13 notifies the items set by the user, to the control unit 100. The control panel 13 performs display so that operation items, which will be described below, can be selected, and thus a user can select an operation mode. In the printing stoppage state, the control panel 13 may display the indication of the printing stoppage state. The display of the indication of the printing stoppage state can be performed by, for example, causing the start key to light with a red color, or displaying characters such as "printing is being stopped" in the display unit.

Next, an example of a temperature change in the developing device of the image forming apparatus of the embodiment will be described using FIG. 3.

Figure 3:
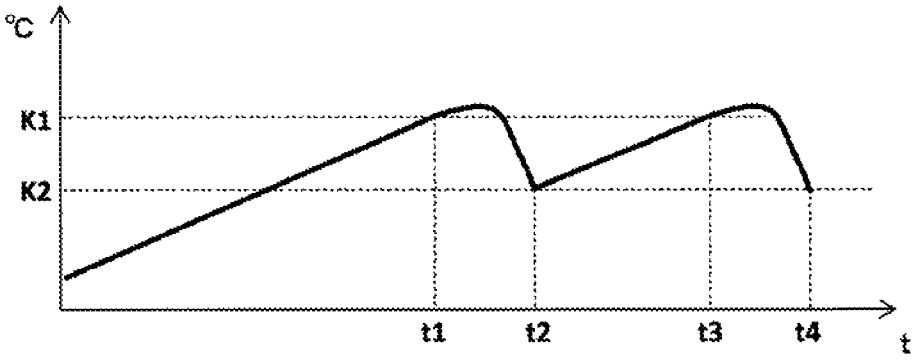
FIG. 3 is a diagram illustrating an example of a temperature change in a developing device of the image forming apparatus of the embodiment.

In FIG. 3, the horizontal axis of the graph indicates elapse of time (t), and the vertical axis of the graph indicates the temperature (° C.) measured by the temperature sensor 11.

A time t1 indicates the time when the temperature is increased as time elapses due to the consecutive printing of sheets and reaches a temperature K1. The time period prior to the time t1 is the time when the image forming apparatus is in the printable state in which printing can be performed. The temperature K1 is a temperature which is set in advance as the temperature at which the image forming apparatus 10 is caused to transition to, or remain in, the printing stoppage state. When the temperature reaches the temperature K1, the control unit 100 causes the printing stoppage state to occur, and allows cooling of the developing device 284. Because the time when the temperature of the heat generation by the auger 292 or the like of the developing device 284 is detected by the temperature sensor 11, after the printing stoppage state occurs at the time t1, a slight overshoot of the temperature occurs in some cases. The temperature K1 is set in view of preventing the melting of the toner. Since the viscosity of the toner is decreased when the temperature is increased, one or more fused masses of the toner is easily generated, so it is desirable that the developing device 284 is maintained at a temperature sufficiently lower than the glass transition point of the toner. Accordingly, in the embodiment, the temperature K1 is set to the glass transition point of the toner or less. In the toner of which the glass transition point is equal to or less than 50° C., the temperature K1 is set to be equal to or less than 50° C. However, if the temperature K1 is set too low, the printable state in which the printing operation can continue becomes short due to the temperature increase, and thus the productivity of printing is reduced. Accordingly, the temperature K1 is set to a value, in which the melting of the toner and the productivity of the image forming apparatus are both taken into consideration, in advance. In FIG. 3, a case in which continuous printing is performed in the printable state is exemplified. However, when there is time during which a printing operation is not performed in the printable state, the time (printable state of the image forming apparatus) until the temperature reaches the temperature K1 becomes further longer.

A time t2 indicates the time when the temperature decreases by the image forming apparatus being in the printing stoppage state, and reaches a temperature K2. That is, a period from the time t1 to the time t2 indicates that the image forming apparatus is in the printing stoppage state. The temperature K2 is a temperature which is set in advance as the temperature at which the image forming apparatus status is changed from the printing stoppage state to the printable state. If the printing operation is stopped, the heat generated from the movement of the auger 292, which is a heat source, is stopped so that the temperature is decreased. For the cooling of the developing device 284, for example, a cooling unit such as a cooling fan may be used. By using such a cooling unit, the time for decreasing the temperature can be shortened. In addition, the temperature increase during the printing operation can be reduced.

The control unit 100 changes the image forming apparatus from the printing stoppage state to the printable state when the temperature reaches the temperature K2. The temperature K2 is set to be equal to or lower than the temperature K1. If the temperature K2 is set to be a temperature close to the temperature K1, since the printing operation is restarted early, the printing stoppage state becomes short. However, if the difference between the temperature K1 and the temperature K2 is small, when the printing operation is restarted, the time to reach the temperature K1 again due to the temperature increase becomes short. For example, in the average operation rate (designed value) of the image forming apparatus 10, if the temperature K1 is set to 50° C., it is possible to secure the productivity of the image forming apparatus for printing by setting the temperature K2 to about 40° C. to 43° C. The setting of the temperature K1 and the temperature K2 may be changed depending on, for example, conditions such as the temperature outside of the image forming apparatus 10 or the number of sheets to be printed.

A time t3 indicates the time when the temperature is increased as time elapses due to the restart of the printing operation, and reaches the temperature K1 again. That is, in the period from the time t2 to the time t3 the image forming apparatus is in the printable state. In the printable state from the time t2 to the time t3, continuous printing is performed. In addition, the time t4 indicates the time when the temperature is decreased due to the stoppage of the printing operation, and again reaches the temperature K2, and printing can resume.

Next, a diagram illustrating an example of the printing stoppage of the image forming apparatus of the embodiment will be described by using FIG. 4.

Figure 4:
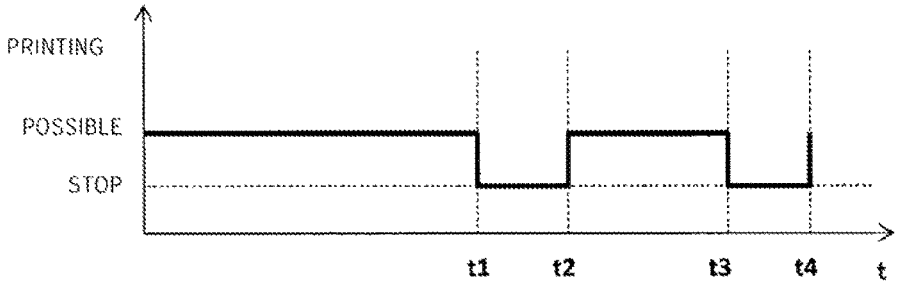
FIG. 4 is a diagram illustrating an example of a printing stoppage of the image forming apparatus of the embodiment.

In FIG. 4, the horizontal axis of the graph indicates the elapse of time (t), and the vertical axis of the graph indicates the printable state (ON) in which printing can be performed (is possible) or the printing stoppage state (OFF) in which printing is stopped. The time t1, the time t2, the time t3, and the time t4 respectively correspond to those times illustrated in FIG. 3.

During the time before the time t1 the image forming apparatus is in the printable state. During the time from the time t1 to the time t2 the image forming apparatus is in the printing stoppage state. During the time from the time t2 to the time t3 the image forming apparatus is in the printable state. In addition, during the time from the time t3 to the time t4 the image forming apparatus is in the printing stoppage state. In the printable state, the control unit 100 controls the printing operation of the printer unit 18. In addition, in the printing stoppage state, the control unit 100 stops the printing operation of the printer unit 18.

Figure 6:
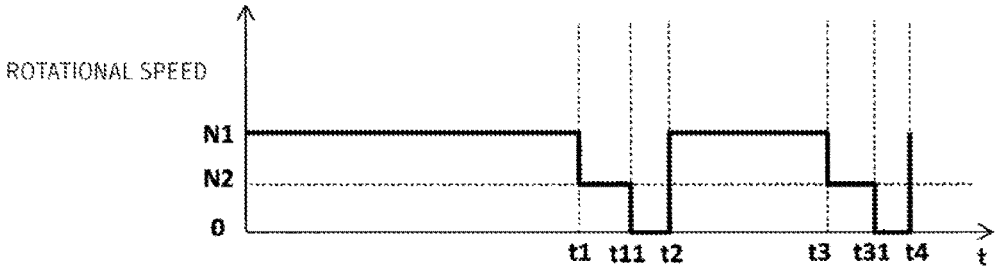
FIG. 6 is a diagram illustrating a second example of the driving pattern of the auger of the developing device of the embodiment.
Figure 7:
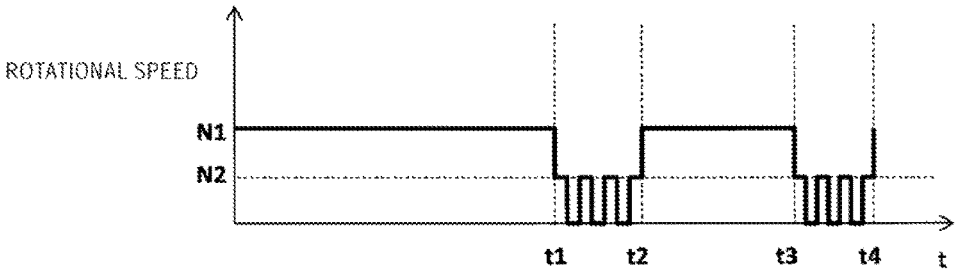
FIG. 7 is a diagram illustrating a third example of the driving pattern of the auger of the developing device of the embodiment.

Next, a first example of a driving pattern of the auger 292 of the developing device of the embodiment will be described by using FIG. 5. Hereinafter, the rotation of the auger 292 will be described as an example of the operation of the movable part. FIG. 6 is a diagram illustrating a second example of the driving pattern of the auger 292, and FIG. 7 is a diagram illustrating a third example of the driving pattern of the auger 292.

Figure 5:
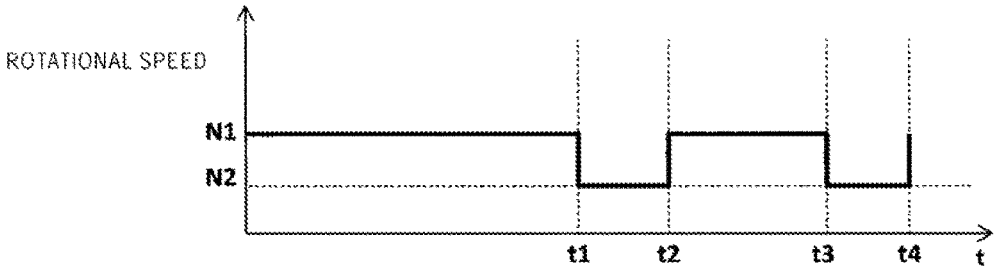
FIG. 5 is a diagram illustrating a first example of a driving pattern of an auger of the developing device of the embodiment.

In FIG. 5, the horizontal axis of the graph indicates the elapse of time (t), and the vertical axis of the graph indicates the rotational speed of the auger 292. The time t1, the time t2, the time t3, and the time t4 respectively correspond to those times illustrated in FIG. 3.

In the printing stoppage state, the control unit 100 rotates the auger 292 so that the developer is stirred and moved, and thus developer is prevented from staying in the hot spot. Further, the control unit 100 rotates the auger 292, and thus the heat of the hot spot is dispersed by the movement of the developer.

In the first example of the driving pattern of the auger 292, the rotational speed of the auger 292 in the printing stoppage state is set as N2. The rotational speed N2 is a rotational speed (rpm) lower than the rotational speed N1 of the auger 292 during the printing operation in the printable state. The rotation of the auger 292 by the rotational speed N2 is referred to as low-speed rotation. The rotation of the auger 292 by the rotational speed N1 is referred to as normal rotation. The amount of heat generated from the auger 292 or the like per unit time in the low-speed rotation is smaller than the heat generated in normal rotation. As the value of the rotational speed N2 becomes smaller, the amount of heat generated from the auger 292 or the like can be reduced. Meanwhile, by reducing the value of the rotational speed N2, the movement of the developer is reduced, and thus the time during which the developer stays in the hot spot is longer. In addition, the dispersion of the heat by the movement of the developer is reduced. By reducing the value of the rotational speed N2, the melting of the toner in the hot spot is more likely to occur. Accordingly, the value of the rotational speed N2 is determined in consideration of both the amount of heat generated from the auger 292 or the like, and the possibility of melting of the toner in the hot spot.

In the embodiment, the rotational speed N2 is set to ¼ to ¾ of the rotational speed N1. More preferably, the rotational speed N2 is less than ½ of the rotational speed N1. It was confirmed that when the rotational speed N2 is set to be equal to or less than ¼ of the rotational speed N1, in the hot spot at a temperature close to the glass transition point, the viscosity of the toner is decreased. In addition, it was confirmed that when the rotational speed N2 is set to be equal to or greater than ¾ of the rotational speed N1, the temperature of the developing device 284 is increased due to the heat generated from the auger 292 or the like. It was confirmed that by setting the rotational speed N2 to ¼ to ¾ of the rotational speed N1, the amount of heat generated from the auger 292 or the like is sufficiently decreased and thus the temperature increase is suppressed. In addition, it was confirmed that in the hot spot close to the glass transition point, the toner was not melted. The rotational speed N2 is set to ½ (50%) of the rotational speed N1 which is the middle of the range of ¼ (25%) to ¾ (75%) of the rotational speed N1.

It is known that the rotational force required for the rotation of the auger 292 is drastically increased due to static friction if the rotational speed is close to 0 (rpm). In order to increase the rotational force in that case, a change of the driving system such as inclusion of a separate motor, or a stronger motor, to drive (turn) the auger is required in some cases. However, it was confirmed that the change of the driving system is not required here by setting the rotational speed N2 to be equal to or greater than ¼ of the normal rotational speed N1.

The change of the rotational speed of the auger 292 can be performed by changing the rotational speed of a motor which drives the auger 292. In addition, the change of the rotational speed of the auger 292 can be performed by changing the gear ratio of a gear which drives the auger 292. The rotational speed of the auger 292 may be the number of revolutions thereof during a predetermined time. For example, if the motor which drives the auger 292 operates in a pulse operation of a stepping motor or the like, the rotation of the auger 292 is performed by repeating the rotation and the stoppage in a pulsed manner. The rotational speed of the auger 292 may be the number of revolution per minute.

Next, a second example of the driving pattern of the auger 292 of the developing device of the embodiment will be described by using FIG. 6. The vertical axis of the graph indicates the rotational speed of the auger 292. The time t1, the time t2, the time t3, and the time t4 respectively correspond to those times illustrated in FIG. 3.

In the second example of the driving pattern of the auger 292, the control unit 100 sets the rotational speed of the auger 292 in the printing stoppage state to N2. The reason of setting the rotational speed to N2 is the same as that of the first example of the driving pattern of the auger 292. In the second example of the driving pattern of the auger 292, the control unit 100 stops the rotation of the auger 292 at a time t11. For example, in a case where the temperature of the hot spot is equal to or less than a temperature (for example, the glass transition point) at which the toner is melted, the movement of the developer can be stopped. By stopping the rotation of the auger 292, the amount of additional heat generated from the auger 292 or the like can be zero, and thus the time during which the temperature is decreased to the temperature K2 can be shortened. In addition, by stopping the rotation of the auger 292 from the time t11 to the time t2, the power consumption of the image forming apparatus can be reduced.

The time t11 can be set to a time which elapses from the time t1 at which the printing stoppage state is started as a predetermined time. In addition, the time t11 may be set to a time at which the temperature has decreased to the temperature K1. The control unit 100 starts the printing operation again at the time t2, and performs similar control at the time t3, a time t31, and the time t4 which are subsequent to the time t2.

Next, a third example of the driving pattern of the auger 292 of the developing device of the embodiment will be described by using FIG. 7. The vertical axis of the graph indicates the rotational speed of the auger 292. The time t1, the time t2, the time t3, and the time t4 respectively correspond to those times illustrated in FIG. 3.

In the third example of the driving pattern of the auger 292, the control unit 100 sets the rotational speed of the auger 292 in the printing stoppage state to N2. The reason of setting the rotational speed to N2 is the same as that of the first example of the driving pattern of the auger 292. In the third example of the driving pattern of the auger 292, the control unit 100 intermittently stops the rotation of the auger 292. Intermittently stopping the rotation of the auger 292 is an operation of repeating the rotation and the stoppage of the auger 292. The pattern of repetition is optional. For example, the control unit 100 can set the time during which the auger 292 is rotated and the time during which the auger 292 is stopped to optional times, respectively. By intermittently stopping the rotation of the auger 292, the power consumption of the image forming apparatus can be reduced. For example, the control unit 100 can set the time period of rotation and the time period of stoppage to the same number of seconds (for example, 3 seconds). In FIG. 7, a case in which the rotational speed N2 and stoppage of rotation are repeated is illustrated, but the rotational speed N1 and the stoppage may be repeated.

Next, a flowchart illustrating an example of an operation of the image forming apparatus of the embodiment will be described by using FIG. 8.

Figure 8:
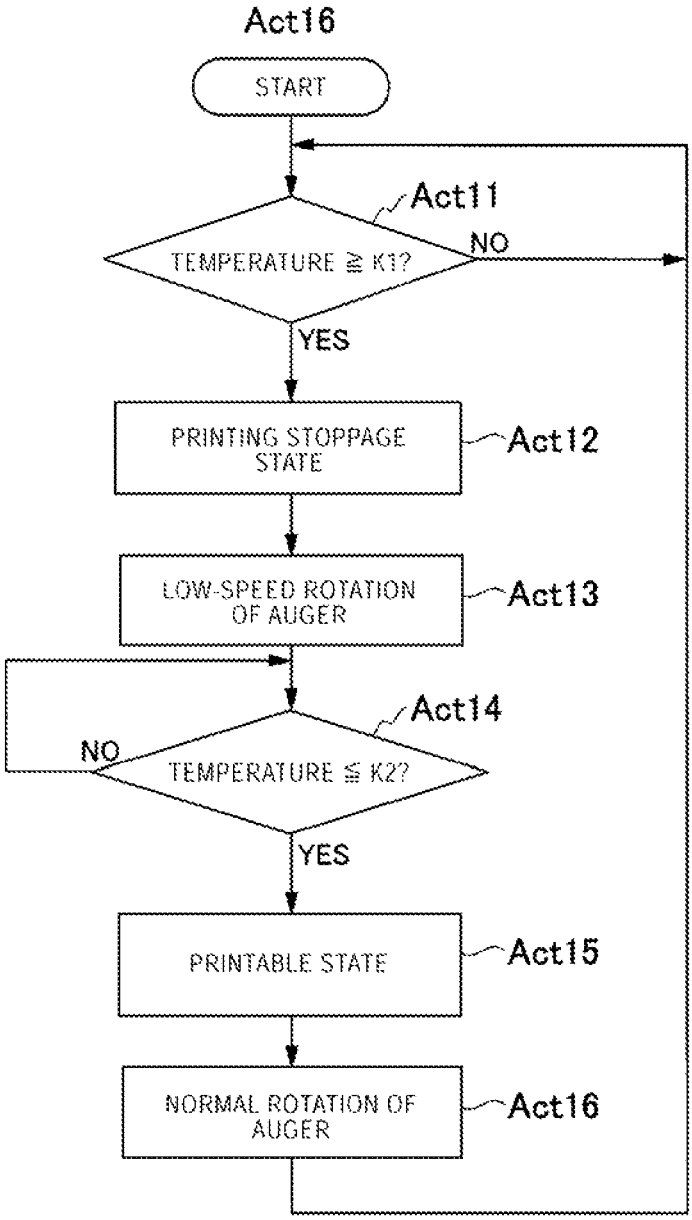
FIG. 8 is a flowchart illustrating an example of an operation of the image forming apparatus of the embodiment.

In FIG. 8, the control unit 100 determines whether or not the temperature is equal to or greater than K1 (Act 11). Whether or not the temperature is equal to or greater than K1 can be determined based on the measured data of the temperature sensor 11. If it is determined that the temperature is not equal to or greater than K1 (NO in Act 11), the control unit 100 continues to repeat the process of Act 11 until the temperature is equal to or greater than K1.

Meanwhile, if it is determined that the temperature is equal to or greater than K1 (YES in Act 11), the control unit 100 stops the printing operation, and changes the state of the image forming apparatus from the printable state to the printing stoppage state (Act 12). By causing the printing stoppage state to occur, the control unit 100 can prevent the temperature of the developing device 284 from being further increased. When the printing stoppage state is implemented, the control unit 100 does not feed a new sheet. In addition, when implementing the printing stoppage state, if there is a sheet on which printing is being performed in the printer unit 18, the control unit 100 completes the printing for the corresponding sheet.

After the process of Act 12 is performed, the control unit 100 switches the rotation of the auger to low-speed rotation. The rotation of the auger during the low-speed rotation can be performed as the operations exemplified in FIG. 5 to FIG. 7. By switching the rotation speed of the auger to the low-speed rotation, the control unit 100 can prevent the toner from being melted during the stoppage of the printing operation.

After the process of Act 13 is performed, the control unit 100 determines whether or not the temperature is equal to or less than K2 (Act 14). Whether or not the temperature is equal to or less than K2, can be determined based on the measured data of the temperature sensor 11. If it is determined that the temperature is not equal to or less than K2 (NO in Act 14), the control unit 100 repeats the process of Act 14, until the temperature is equal to or less than K2.

Meanwhile, if it is determined that the temperature is equal to or less than K2 (YES in Act 14), the control unit 100 changes the state of the image forming apparatus from the printing stoppage state to the printable state (Act 15). If there is printing data which is not yet printed, the control unit 100 restarts the printing operation. After the process of Act 15 is performed, the control unit 100 switches the rotation speed of the auger to the normal rotation (Act 16). After the process of Act 16 is performed, the control unit 100 causes the process to return to Act 11, and repeats the process described in this flowchart. Optionally, another step can be implemented, wherein the auger rotation speed can temporarily set to zero following the pattern of rotation of FIGS. 7 and 8.

The above-described image forming apparatus of the embodiment includes a developing device, a temperature sensor, and a control unit. The developing device contains a toner and includes a movable part in contact with the toner. The temperature sensor is disposed in the periphery of the developing device and detects a temperature. The control unit changes the state of the image forming apparatus from a printable state in which printing can be performed using the developing device to a printing stoppage state in which printing is stopped, when the detected temperature is equal to or greater than a predetermined (preset) first temperature. The control unit operates the movable part at a first speed in the printable state, and causes the operation of the movable part to continue at a second speed lower than the first speed in the printing stoppage state. By this configuration, the image forming apparatus can prevent the toner from being melted during the stoppage of the printing operation.

In addition, in the image forming apparatus of the embodiment, the control unit sets the second speed to a speed which is equal to or less than ½ of the first speed. By this configuration, the image forming apparatus can prevent the toner from being melted during the stoppage of the printing operation, and also prevent the temperature of the developing device from being further increased.

In addition, in the image forming apparatus of the embodiment, in a case where the temperature is decreased to be equal to or less than the second temperature in the printing stoppage state, the control unit changes the state of the image forming apparatus from the printing stoppage state to the printable state. By this configuration, the image forming apparatus can improve the productivity of printing.

In addition, in the image forming apparatus of the embodiment, the control unit provides a time during which the operation of the movable part at the second speed is stopped in the printing stoppage state. By this configuration, the image forming apparatus can have reduced power consumption.

In addition, in the image forming apparatus of the embodiment, the control unit provides a time during which the operation of the movable part is intermittently stopped in the printing stoppage state. By this configuration, the image forming apparatus can have reduced power consumption.

In addition, in the image forming apparatus of the embodiment, the developing device contains a toner of which the glass transition point is equal to or less than 50° C. In this configuration, even in an image forming apparatus with low-power consumption, the toner can be prevented from being melted during the stoppage of the printing operation.

According to at least one embodiment described above, the image forming apparatus includes the developing device, the temperature sensor, and the control unit so as to prevent the toner from being melted during the stoppage of the printing operation.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus comprising:

a developing device including a developing roller and an auger that can rotate at a first speed and a second speed that is slower than the first speed, the auger being rotated while a developer is stirred and supplied to the developing roller;

a temperature sensor disposed adjacent to the developing device; and a control unit operatively coupled to the temperature sensor and the developing device, wherein the control unit: controls the auger to rotate at the first speed during a printing operation when a temperature detected by the temperature sensor is lower than a first temperature, and controls the auger to rotate at the second speed while the printing operation is suspended when the temperature detected by the temperature sensor is higher than the first temperature.

2. The apparatus according to claim 1, wherein the second speed is less than ½ of the first speed.

3. The apparatus according to claim 1, wherein the control unit, when the detected temperature is equal to or lower than a second temperature that is higher than the first temperature and the auger has been rotating at the second speed, controls the auger to resume rotating at the first speed.

4. The apparatus according to claim 3, wherein the control unit controls the auger to begin rotating at the second speed at a set time after a temperature higher than the second temperature is detected by the temperature sensor.

5. The apparatus according to claim 1, wherein the control unit controls the auger to rotate at the second speed for at least a predetermined period of time after the auger has begun rotating at the second speed.

6. The apparatus according to claim 1, wherein the developing device contains a toner having a glass transition point equal to or less than 50° C.

7. The apparatus according to claim 4, wherein the set time after the temperature higher the second temperature is detected by the temperature sensor is based on a predicted increase in temperature.

8. The apparatus according to claim 1, wherein the control unit suspends the printing operation after completing printing on a sheet currently being printed when the detected temperature is higher than the first temperature.

9. An image forming apparatus for printing an image on a print media, comprising:

an image forming unit including an auger that is rotatable at a first speed and a second speed that is slower than the first speed and configured to move toner for printing an image on the print media;

a temperature sensor disposed adjacent to the image forming unit and configured to detect a temperature indicative of a temperature of the image forming unit; and a control system connected to the temperature sensor, wherein the control system:

monitors the temperature of the image forming unit using the temperature sensor, and suspends printing the image on the print media and controls the auger to rotate at the second speed upon detecting that the temperature of the image forming unit is equal to or above a predetermined temperature.

10. The apparatus of claim 9, wherein the control system controls of the auger to rotate at the first speed when the temperature of the image forming unit is lower than the predetermined temperature.

11. The apparatus of claim 10, wherein the second speed is less than one half the first speed.

12. The apparatus of claim 10, wherein the control system controls the auger to rotate at the second speed after an elapse of time after detecting that the temperature of the image forming unit is equal to or above the predetermined temperature.

13. The apparatus of claim 9, wherein the control system controls the auger to resume rotating at the first speed when the temperature of the image forming unit falls below the predetermined temperature.

14. The apparatus of claim 13, wherein, before the control system controls the auger to resume rotating at the first speed, the control system stops the auger at least once.

15. The apparatus of claim 9, further comprising a motor operatively connected to the auger, and the control system controls the motor to rotate the auger.

16. The apparatus of claim 9, wherein the predetermined temperature is equal to or below the glass transition temperature of a toner usable with the image forming apparatus.

17. A method of operating an image forming apparatus, comprising:

mixing a toner with a developer in a developing device of an image forming apparatus using an auger, the developing device being at a location adjacent to a photoreceptor of the image forming apparatus;

performing a printing operation and rotating the auger at a first speed while detecting a temperature of the developing device; and suspending the printing operation and rotating the auger at a second speed that is slower than the first speed in response to detecting the temperature of the developing device to be equal to or higher than a first temperature.

18. The method of claim 17, further comprising:

rotating the auger at the first speed after the auger has been rotating at the second speed in response to detecting the temperature of the developing device to be equal to or lower than a second temperature, wherein the second temperature is higher than the first temperature.

19. The method of claim 18, further comprising:

before starting to rotate the auger at the first speed in response to detecting the temperature of the developing device to be equal to or lower than the second temperature, stopping rotation of the auger.

* * * * *